US006097925A

United States Patent [19]

Nagaoka et al.

[11] Patent Number: 6,097,925

[45] Date of Patent: Aug. 1, 2000

[54] PRINT MEDIUM GUIDE FOR ELECTROPHOTOGRAPHIC PRINTER

[75] Inventors: Kazuhiko Nagaoka; Koji Ida, both of Tokyo, Japan

[73] Assignee: Oki Data Corporation, Tokyo, Japan

[21] Appl. No.: 09/186,814

[22] Filed: Nov. 5, 1998

[30] Foreign Application Priority Data

Nov. 12, 1997 [JP] Japan ..... 9-310443

[51] Int. Cl.[7] ..... G03G 15/16

[52] U.S. Cl. ..... 399/316

[58] Field of Search ..... 399/297, 310, 399/313, 314, 316, 317, 388, 389, 390, 121, 124, 66; 271/3.15, 3.17, 227, 253, 254

[56] References Cited

U.S. PATENT DOCUMENTS 5,276,489 1/1994 Kikuchi et al. ..... 399/316
5,337,128 8/1994 Hashizume et al. ..... 399/314
5,424,818 6/1995 Yoshimura et al. ..... 399/313
5,915,145 6/1999 Shimura et al. ..... 399/66

*Primary Examiner*—William Royer
*Assistant Examiner*—Hoan Tran
*Attorney, Agent, or Firm*—Akin, Gump, Strauss, Hauer & Feld, L.L.P.

[57] ABSTRACT

An electrophotographic printer includes a transfer roller which rotates in contact with a cylindrical photoconductive drum. When print paper passes through a transfer point where the transfer roller is in contact with the photoconductive drum, a toner image on the photoconductive drum is transferred from the photoconductive drum to the print paper. A paper guide is disposed upstream of the transfer point with respect to a transport path of the print paper. The paper guide changes the direction of travel of the print paper so that the leading end portion of the print paper enters the transfer point in a direction substantially tangent to a circumferential surface of the photoconductive drum.

24 Claims, 20 Drawing Sheets

FIG.16

| TEMPERATURE [℃] | AUXILIARY VOLTAGE (V) | | | | | |
|---|---|---|---|---|---|---|
| | H<10 | 10≦H<30 | 30≦H<50 | 50≦H<70 | 70≦H<90 | 90≦H |
| 0<T≦5 | 1000 | 900 | 800 | 700 | 600 | 500 |
| 0<T≦10 | 800 | 800 | 700 | 600 | 500 | 400 |
| 10<T≦15 | 700 | 700 | 600 | 500 | 400 | 300 |
| 15<T≦20 | 600 | 600 | 500 | 400 | 300 | 200 |
| 20<T≦25 | 500 | 500 | 400 | 300 | 200 | 100 |
| 25<T≦30 | 500 | 400 | 300 | 200 | 100 | 50 |

H : HUMIDITY(%)

FIG.17

| KIND OF PAPER | AUXILIARY VOLTAGE (V) | | | | | |
|---|---|---|---|---|---|---|
| | ε1 | ε2 | ε3 | ε4 | ε5 | ε6 |
| M1 | 1000 | 900 | 800 | 700 | 600 | 500 |
| M2 | 800 | 800 | 700 | 600 | 500 | 400 |
| M3 | 700 | 700 | 600 | 500 | 400 | 300 |
| M4 | 600 | 600 | 500 | 400 | 300 | 200 |

ε1−ε6 : ENVIRONMENTS

FIG.20

| KIND OF PAPER | ANGLE, $\alpha$ (°) | | | | | |
|---|---|---|---|---|---|---|
| | H<10 | 10≦H<30 | 30≦H<50 | 50≦H<70 | 70≦H<90 | 90≦H |
| M1 | 45 | 45 | 45 | 40 | 35 | 30 |
| M2 | 40 | 40 | 40 | 40 | 40 | 40 |
| M3 | 30 | 30 | 30 | 25 | 20 | 15 |

H : HUMIDITY(%)

FIG.23

| KIND OF PAPER | DISTANCE (mm) | | | | | |
|---|---|---|---|---|---|---|
| | H<10 | 10≦H<30 | 30≦H<50 | 50≦H<70 | 70≦H<90 | 90≦H |
| M1 | 1 | 1 | 1 | 1 | 0 | 0 |
| M2 | 2 | 2 | 2 | 1 | 1 | 0 |
| M3 | 3 | 3 | 3 | 2 | 2 | 1 |

H : HUMIDITY(%)

| KIND OF PAPER | NEUTRALIZATION VOLTAGE [V] |
|---|---|
| M1 | 800 |
| M2 | 1200 |
| M3 | 2000 |

FIG.30

| TEMPERATURE [℃] | ENVIRONMENT | | | | | | | |
|---|---|---|---|---|---|---|---|---|
| | H<20 | 20≦H<30 | 30≦H<40 | 40≦H<50 | 50≦H<60 | 60≦H<70 | 70≦H<80 | 80≦H |
| T<0 | ε 8 | ε 8 | ε 7 | ε 7 | ε 6 | ε 6 | ε 6 | ε 5 |
| 0≦T<5 | ε 8 | ε 7 | ε 7 | ε 6 | ε 6 | ε 6 | ε 5 | ε 5 |
| 5≦T<10 | ε 8 | ε 7 | ε 6 | ε 6 | ε 5 | ε 5 | ε 5 | ε 4 |
| 10≦T<15 | ε 8 | ε 7 | ε 6 | ε 5 | ε 4 | ε 4 | ε 4 | ε 3 |
| 15≦T<20 | ε 7 | ε 6 | ε 5 | ε 4 | ε 4 | ε 4 | ε 3 | ε 3 |
| 20≦T<25 | ε 7 | ε 5 | ε 4 | ε 4 | ε 3 | ε 3 | ε 3 | ε 2 |
| 25≦T<30 | ε 6 | ε 5 | ε 4 | ε 3 | ε 2 | ε 2 | ε 2 | ε 2 |
| 30≦T | ε 5 | ε 4 | ε 3 | ε 3 | ε 2 | ε 2 | ε 2 | ε 1 |

H : HUMIDITY(%)

| TEMPERATURE [℃] | TRANSFER VOLTAGE (V) | | | | | | | |
|---|---|---|---|---|---|---|---|---|
| | ε 1 | ε 2 | ε 3 | ε 4 | ε 5 | ε 6 | ε 7 | ε 8 |
| M1 | 500 | 600 | 800 | 1000 | 1500 | 2000 | 2500 | 3000 |
| M2 | 800 | 1000 | 1200 | 1400 | 1600 | 1800 | 2000 | 2200 |
| M3 | 1000 | 1500 | 2000 | 2500 | 3000 | 3500 | 4000 | 4500 |

ε 1 − ε 8 : ENVIRONMENTS

| KIND OF PAPER | DRIVE VOLTAGE (V) |
|---|---|
| M1 | 18 |
| M2 | 20 |
| M3 | 24 |

PRINT MEDIUM GUIDE FOR ELECTROPHOTOGRAPHIC PRINTER

BACKGROUND OF THE INVENTION

1. Field of the Invention

The present invention relates to an electrophotographic printer.

2. Description of the Related Art

FIG. 35 illustrates a general construction of a conventional electrophotographic printer. FIG. 36 is a side view of a paper transporting path of the conventional electrophotographic printer. Referring to FIG. 35, a photoconductive drum 11 rotates in a direction shown by arrow A about a rotational axis passing through a center O. A charging roller 12 receives a negative voltage and rotates in contact with the photoconductive drum 11, so that the entire surface of the photoconductive drum 11 is negatively uniformly charged. The charged surface of the photoconductive drum 11 is then exposed to image light emitted from a LED head 13, so that an electrostatic latent image is formed on the surface. Then, the electrostatic latent image is transported to a developing section 14 where the electrostatic latent image is developed with charged toner 15 into a toner image.

Then, print paper 16 is fed to a transfer point P1 where the photoconductive drum 11 is in contact with a transfer roller 17 that rotates in a direction shown by arrow B. When the paper 16 reaches the transfer point P1, a transfer power supply 18 applies a positive voltage to the transfer roller 17 so as to develop an electric field across the photoconductive drum 11 and the transfer roller 17. The electric field exerts a Coulomb force on the toner 15 so that the toner 15 is attracted to the print paper 16. In this manner, the toner image is transferred from the photoconductive drum 11 to the print paper 16. Some of the toner 15 still remains on the surface of the photoconductive drum 11 after the toner image has been transferred to the print paper 16. Such residual toner is recovered by a cleaning device 19.

With the aforementioned conventional electrophotographic printers, the transfer voltage needs to be maintained within a range of transfer voltage in which a good transfer operation can be carried out, in order to achieve good printing result without deterioration of image quality of the print.

A voltage lower than a lower limit of the optimum transfer-voltage range causes blurred images. In contrast, a voltage higher than an upper limit of the range causes too high an electric field with the result that the toner particles are forced to be pulled from the surface of the photoconductive drum toward the transfer roller before the toner particles are normally carried by the photoconductive drum to the transfer point P1. In any case, the transfer result is poor. When the toner particles are pulled away from the photoconductive drum, the image quality is seriously deteriorated.

One solution is to control the transfer power supply 18 so that the transfer voltage is within the optimum transfer-voltage range in which reasonable transfer can be accomplished. However, good transfer result can be obtained only in a narrow range of transfer voltage and therefore it is difficult to control the transfer voltage within such a narrow range. In addition, good transfer result can be obtained in different ranges of transfer voltage depending on the kind of print paper 16 and environmental conditions (temperature, humidity, and so on) in which the electrophotographic printer is placed. Thus, the transfer voltage needs to be changed in accordance with, for example, the kind of print paper 16 and the environmental conditions. This makes the control of transfer voltage more difficult.

SUMMARY OF THE INVENTION

The present invention was made in view of the aforementioned conventional electrophotographic printer.

An object of the invention is to provide an electrophotographic printer which improves printed image quality and eliminates the need for a closely controlled transfer voltage.

An electrophotographic printer includes a transfer roller which rotates in contact with a cylindrical photoconductive drum. When print paper passes through a transfer point where the transfer roller is in contact with the photoconductive drum, an electric field is developed between the transfer roller and the photoconductive drum so that a toner image is transferred from the photoconductive drum to the print paper. A print medium guide is disposed upstream of the transfer point with respect to a transport path of the print paper. The print medium guide changes the direction of travel of the print paper so that the leading end portion of the print medium enters the transfer point in a direction substantially tangent to a circumferential surface of the photoconductive drum.

Further scope of applicability of the present invention will become apparatus form the detailed description given hereinafter. However, it should be understood that the detailed description and specific example, while indicating preferred embodiments of he invention, are given by way of illustration only, since various changes and modifications within the spirit and scope of the invention will become apparatus within the spirit and scope various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 16 is a table which lists auxiliary voltages for different temperature ranges and humidity ranges in a twelfth embodiment;

FIG. 17 illustrates the relationship between the kinds of print paper and auxiliary voltages in the thirteenth embodiment;

FIG. 20 is a table of an eleventh embodiment that lists circumferential distances of an auxiliary transfer roller 61 from a main transfer roller 17 expressed in terms of angle;

FIG. 23 is a table that lists the distances between the photoconductive drum 11 and the auxiliary transfer roller 61 for different kinds of print paper 16 and the ranges of humidity;

FIG. 30 is a table that lists environments defined for different ranges of temperature and different ranges of humidity of a nineteenth embodiment;

DETAILED DESCRIPTION OF THE INVENTION

Embodiments of the invention will be described in detail with reference to the drawings.

First Embodiment

Figure 1:
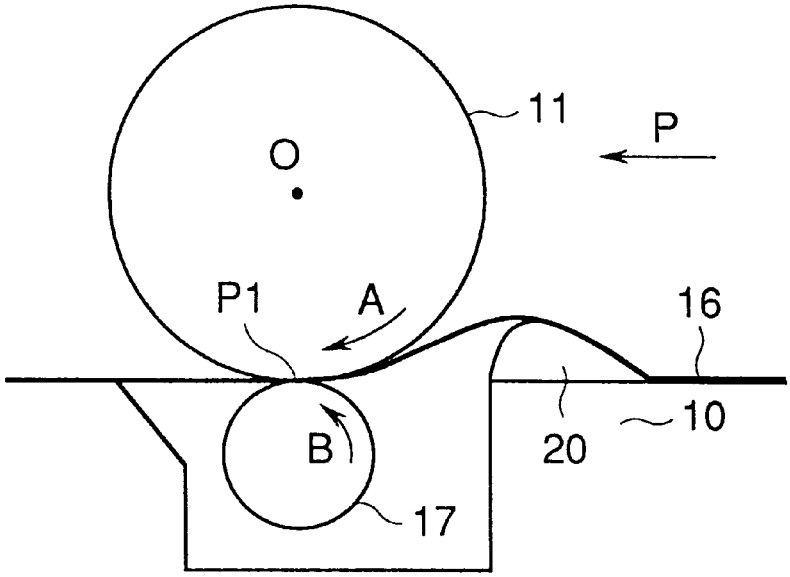
FIG. 1 illustrates an electrophotographic printer according to a first embodiment of the invention.
Figure 2:
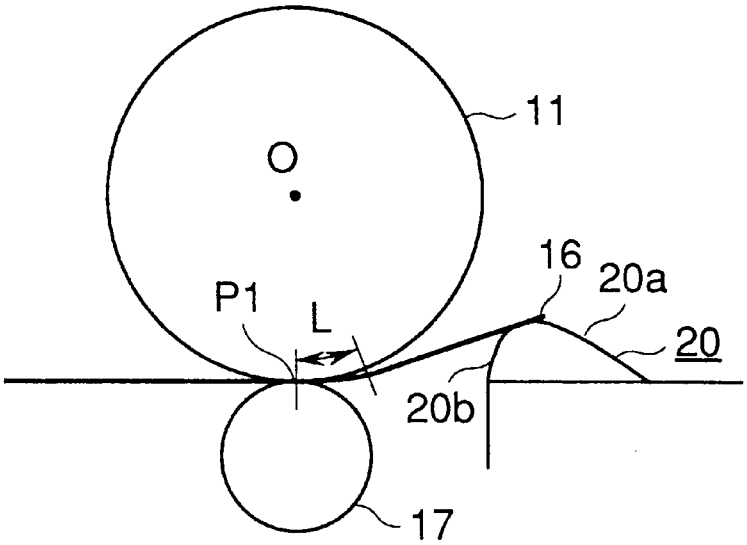
FIG. 2 illustrates effective transfer length of the first embodiment.

FIG. 1 illustrates an electrophotographic printer according to a first embodiment of the invention. FIG. 2 illustrates an effective transfer length L of the first embodiment.

Referring to FIG. 1, a photoconductive drum 11 rotates in a direction shown by arrow A about its rotational axis passing through a center O thereof. The entire circumferential surface of the photoconductive drum 11 as an image-bearing body is uniformly charged by a charging roller, not shown. The surface is then exposed to image light emitted from a LED head, not shown, that serves as image-writing means to form an electrostatic latent image on the surface.

The electrostatic latent image is developed with toner into a toner image in a developing section, not shown. The toner image is then transferred to the print paper 16 by the Coulomb force exerted by a transfer roller 17. The transfer roller 17 takes the form of an electrically conductive rubber roller and rotates in a direction shown by arrow B. A paper guide 20 as print medium-guiding means is disposed beside the photoconductive drum 11 and extends parallel to the rotational axis of the photoconductive drum 11. The length of the paper guide 20 is the same as or longer than that of the photoconductive drum 11. The paper guide 20 has a D-shaped cross section with a flat side facing down and a curved side extending toward the photoconductive drum 11. The curved side has an up slope 20*a* that gradually goes up toward the photoconductive drum 11 and a down slope 20*b* that sharply goes down toward the photoconductive drum 11.

With an electrophotographic printer of the aforementioned construction, the print paper 16 travelling on a plate 10 is guided first upward then downward by the paper guide 20 so that the print paper 16 moves into contact engagement with the photoconductive drum just before a transfer point P1 which is a surface area of the photoconductive drum 11 in contact with the transfer roller 17. Then, the leading end of the print paper 16 reaches the transfer point P1. This way of transporting the print paper 16 ensures that the leading end portion of the print paper 16 first approaches very close to the photoconductive drum 11 and is then fed to the transfer point P1. This implies that the print paper 16 is brought into contact with the photoconductive drum 11 at a location upstream of the transfer point P1 with respect to a direction of travel of the print paper 16, shown by arrow P. Then, the print paper 16 is pulled into the transfer point P1 where a positive voltage applied to the transfer roller 17 causes an electric field to be developed between the transfer roller 17 and the photoconductive drum 11. Thus, a Coulomb force acts on the toner 15 in the electric field so that the toner 15 is attracted toward the transfer roller 17. Thus, the toner 15 adheres to the print paper 16. In this manner, the toner image is transferred from the photoconductive drum 11 to the print paper 16.

The paper guide 20 is arranged so that $L \geqq 1.5$ mm, where L is an effective transfer length. The effective transfer length is a circumferential distance on the surface of the photoconductive drum 11 as shown in FIG. 2 over which the print paper 16 travels till the print paper 16 reaches the transfer point P1 after the leading end of the print paper 16 has moved into contact with the photoconductive drum 11. It is to be noted that an effective transfer length L of a conventional electrophotographic printer is substantially zero millimeters.

As described above, the print paper 16 is brought into contact with the photoconductive drum 11 before the print paper 16 reaches the transfer point p1. This prevents the toner 15 from being pulled away from the surface of the photoconductive drum 11 by the Coulomb force exerted by the electric field between the photoconductive drum 11 and the transfer roller 17. When the leading end of the print paper 16 reaches the transfer point P1 as the photoconductive drum 11 rotates, the toner 15 clings to the print paper 16 due to the Coulomb force exerted by the electric field developed between the photoconductive drum 11 and the transfer roller 17.

Thus, even if a transfer voltage is somewhat higher than the upper limit of an optimum transfer-voltage range in which a good transfer is effected, the toner 15 will not be pulled away from the surface of the photoconductive drum 11. This implies that the transfer voltage can be set somewhat higher than the upper limit of the optimum-transfer voltage range while still preventing the toner from being pulled away from the surface of the photoconductive drum 11. Thus, the quality of printed images is improved. Thus, an effective optimum transfer-voltage range is wider, allowing easy control of the transfer voltage. The transfer voltage can also be controlled without difficulty in accordance with the kind of print paper 16 and environmental conditions for printing operation.

Second Embodiment

Figure 3:
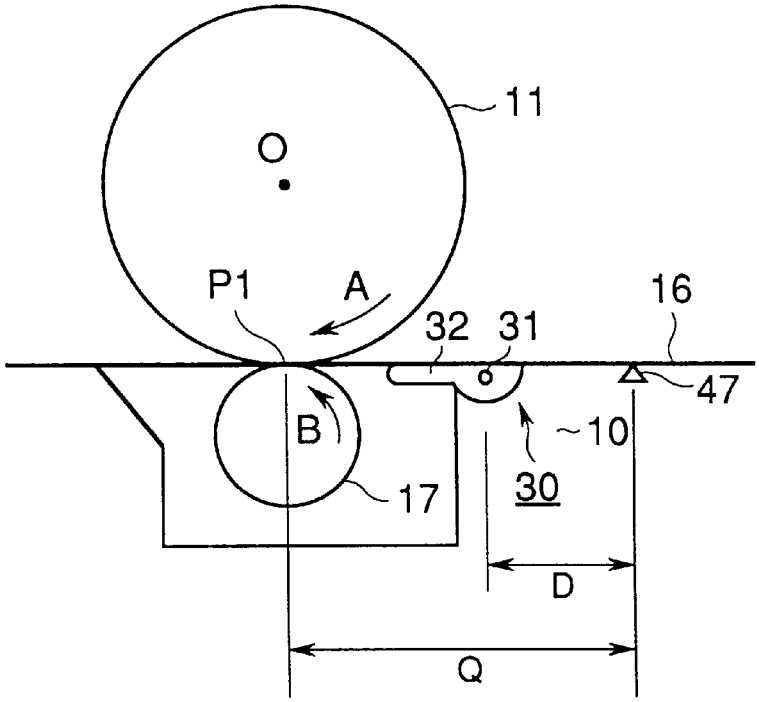
FIG. 3 is illustrates a second embodiment when a paper guide is at a first position.

FIG. 3 is illustrates the second embodiment when a paper guide is at a first position.

Figure 4:
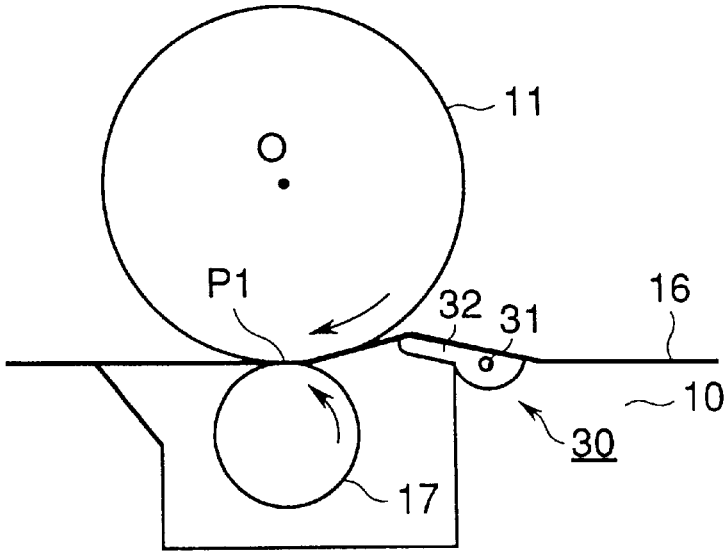
FIG. 4 illustrates the second embodiment when the paper guide is at a second position.

FIG. 4 illustrates the second embodiment when the paper guide is at a second position.

Referring to FIGS. 3 and 4, a paper guide 30 extends across the full length of the photoconductive drum 11, and is parallel to a rotational axis of the photoconductive drum 11 passing through a center O of the photoconductive drum 11. The paper guide 30 is located upstream of the photoconductive drum 11 with respect to the direction of travel of the print paper 16. The paper guide 30 includes a pin 31 and a flap 32 that pivots about the pin 31. The flap 32 can be set at an arbitrary angular position between a horizontal position and a maximum inclined position. The inclination of the flap 32 may be adjusted either continuously or stepwise. A sensor 47 is located at a distance D upstream of the flap 32 and detects the leading end of the print paper 16. The flap is inclined upward when the sensor 47 detects the print paper 16.

When the flap 32 is at its horizontal position, the effective transfer length L is L=0 mm. When the flap 32 is at its maximum inclined position, the effective transfer length $L \geqq 1.5$ mm.

When the flap 32 is set at a predetermined angular position as shown in FIG. 4, the print paper 16 travelling on the plate 10 is guided first upward then downward by the paper guide 30 so that the leading end of the print paper 16 reaches the transfer point P1 defined between the photoconductive drum 11 and the transfer roller 17. Thus, the leading end of the print paper 16 first moves very close to and then into contact with the photoconductive drum 11. Thereafter, the leading end reaches the transfer point P1. Thus, the print paper 16 is brought into contact with the photoconductive drum 11 at a location upstream of the transfer point P1.

The longer the effective transfer length L is, the smaller the amount of toner that is pulled away from the photoconductive drum 11. A large inclination of the flap 32 achieves a longer effective transfer length L. However, the inclination of the flap 32 is, the narrower the flap 32 makes a gap between the photoconductive drum 11 and the tip of the flap 32.

In the second embodiment, the flap 32 can be set to an optimum angular position in accordance with the thickness of the print paper 16, thereby preventing poor transfer results as well as improving the quality of printed images irrespective of the kinds of print paper.

Third Embodiment

Figure 5:
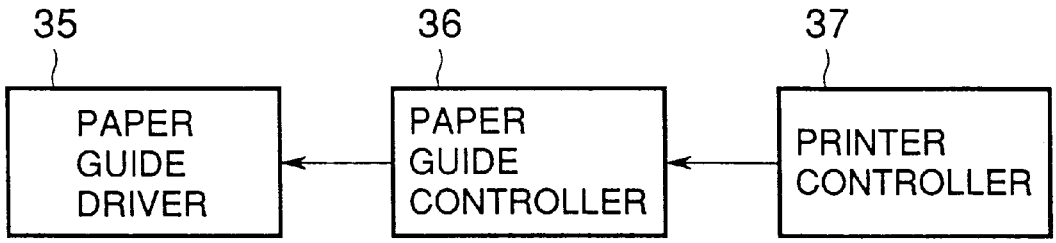
FIG. 5 is a block diagram illustrating an electrophotographic printer according to a third embodiment.
Figure 6:
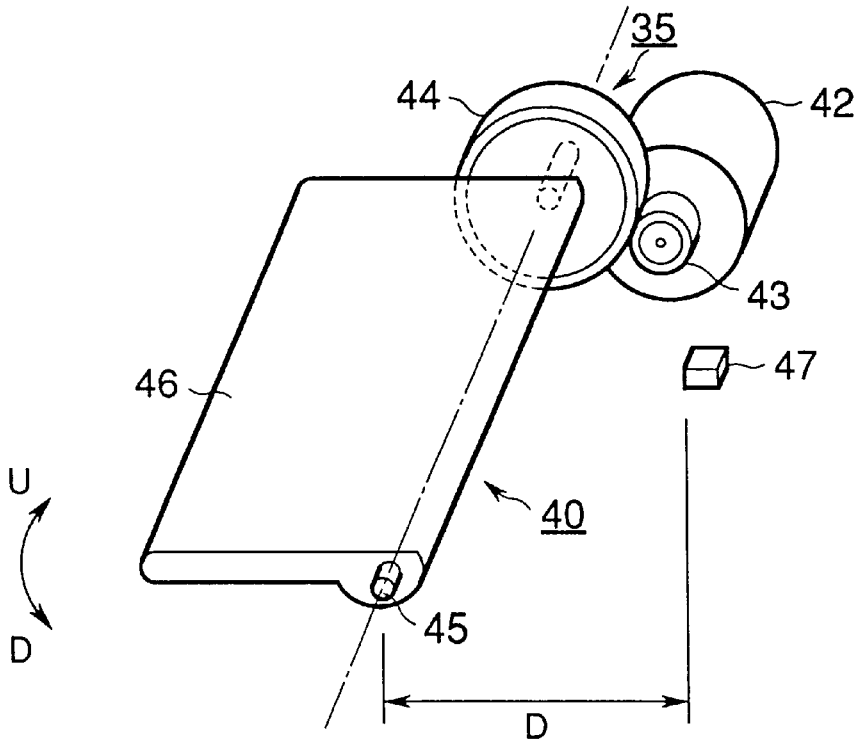
FIG. 6 is a perspective view showing a paper guide driver of the third embodiment.
Figure 7:
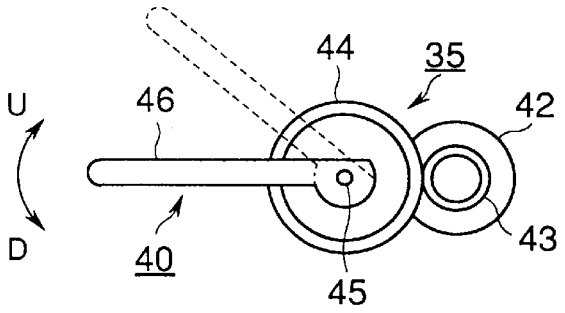
FIG. 7 is a side view showing the paper guide driver of FIG. 6.

FIG. 5 is a block diagram illustrating an electrophotographic printer according to a third embodiment. FIG. 6 is a perspective view showing a paper guide driver of the third embodiment. FIG. 7 is a side view showing the paper guide driver of FIG. 6.

Referring to FIG. 5, a paper guide controller 36 controls a paper guide driver 35. A printer controller 37 includes a CPU, a RAM, and logic circuits, not shown, and controls the overall operation of the printer.

The paper guide driver 35 includes a motor (e.g. stepping motor) 42 that drives a paper guide 40, and gears 43 and 44 disposed between the paper guide 40 and the motor 42. The gear 43 is in mesh with the gear 44 which is fixed to the paper guide 40. The paper guide 40 includes a pin 45 and a flap 46 that is pivoted by the about the pin 45 in directions shown by arrows U and D. The motor 42 drives the flap 46 via the gears 43 and 44 to incline to any angular positions continuously or stepwise between a horizontal position (solid line position) and a maximum inclined position (dotted line position) as shown in FIG. 7.

The printer controller 37 causes the motor 42 to automatically change the inclination of the flap 46 in accordance with the thickness of the print paper 16 either specified by the user or detected by a paper sensor 47. Thus, a good transfer result is ensured even though the optimum transfer-voltage range varies depending on the kind of the print paper 16.

Moreover, the automatic adjustment of the inclination of the flap 46 simplifies the operations to be performed by the user.

Fourth Embodiment

Figure 8:
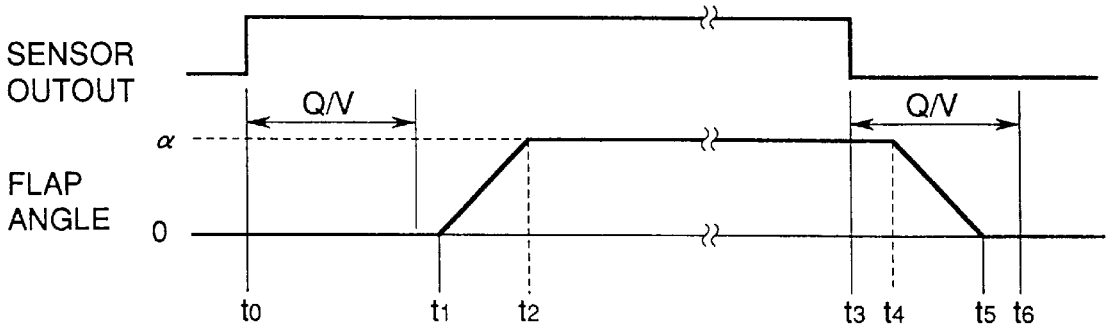
FIG. 8 is a timing chart illustrating the operation of the paper guide according to a fourth embodiment.

FIG. 8 is a timing chart illustrating the operation of the paper guide according to a fourth embodiment.

In the fourth embodiment, paper guide is of the same construction as that of the third embodiment.

When the print paper 16 travels at a speed V toward the transfer point P1, the paper sensor 47, located at a distance Q upstream of the transfer point P1, detects the leading end of the print paper 16 at time t0. A predetermined time after the detection of the leading end of the print paper 16, the paper guide controller 36 causes the motor 42 to rotate in a forward direction, so that the flap 46 begins to tilt upward at time t1 and stops at or just before time t2 after having rotated through a predetermined angle $\alpha$. Time t2 is a timing such that the forward end of the toner image on the photoconductive drum reaches the transfer point P1. The flap 46 begins to rotate a short time after the leading end of the print paper 16 has reached the transfer point P1. Alternatively, the flap 46 may be controlled to begin to rotate at the same time that the leading end of the print paper 16 reaches the transfer point P1. Then, the print paper 16 further travels through the transfer point P1. Then, the paper sensor 47 detects the trailing end of the print paper 16 at time t3. The paper guide controller 36 causes the motor 42 to rotate in a reverse direction at time t4 so that the flap 46 will rotate through the angle $\alpha$ in the reverse direction. Time t4 is a timing such that the rearward end of the toner image on the photoconductive drum reaches the transfer point P1. The flap 46 returns to the original position at time t5 before the training end of the print paper 16 leaves the flap 46 at time t6.

As described above, the flap 46 starts to rotate as soon as or after the leading end of the print paper 16 has reached the transfer point P1. Thus, the print paper 16 can be advanced smoothly to the transfer point P1, preventing the print paper from being jammed. The flap 46 is set to an inclination of zero degrees before the trailing end of the print paper 16 leaves the flap 46. Gradually changing the inclination of the paper guide 40 prevents the toner 15 from being pulled away from the surface of the photoconductive drum due to mechanical shocks when the print paper 16 leaves the paper guide 40.

Thus, the fourth embodiment is effective in preventing poor transfer results.

Fifth Embodiment

Figure 9:
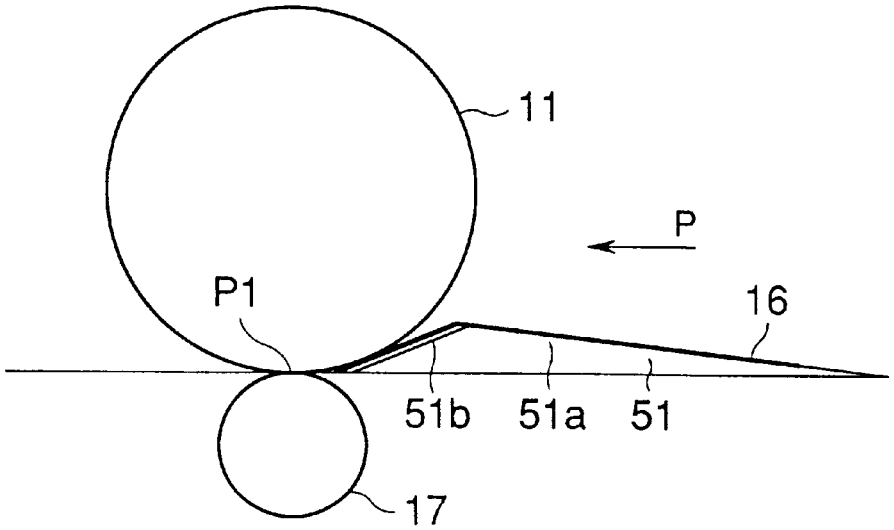
FIG. 9 is an illustrative diagram of an electrophotographic printer according to a fifth embodiment.

FIG. 9 is an illustrative diagram of an electrophotographic printer according to a fifth embodiment. Elements of the same construction as those in the first embodiment have been given the same reference numerals and the description thereof is omitted.

In the fifth embodiment, the paper guide 51 is located between a paper-feeding mechanism, not shown, and the transfer point P1. The paper guide 51 has an up-slope 51*a* gradually going up toward the photoconductive drum 11 and a down-slope 51*b* steeply going down toward the photoconductive drum 11. This combination of different slopes allows the print paper 16 to be smoothly fed to the transfer point P1, thereby preventing paper jam.

Sixth Embodiment

Figure 10:
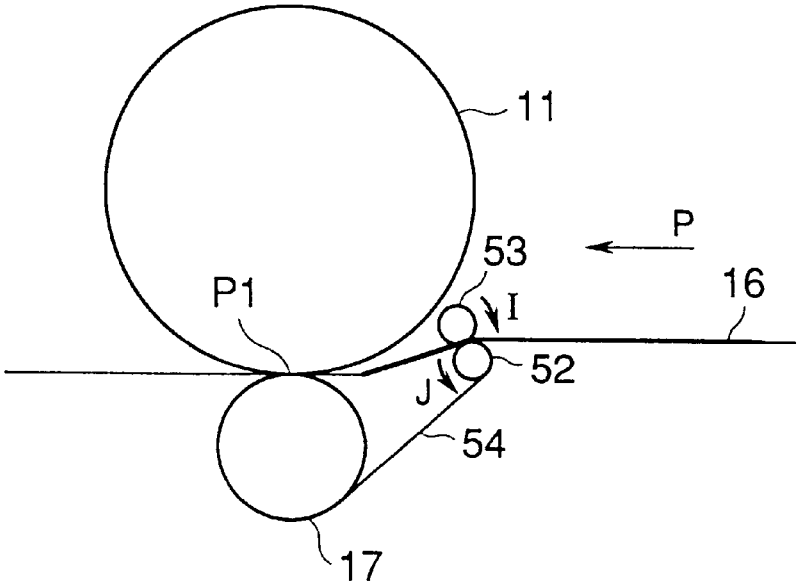
FIG. 10 illustrates an electrophotographic printer according to a sixth embodiment.

FIG. 10 illustrates an electrophotographic printer according to sixth embodiment.

A feed roller 52 is disposed in proximity to the photoconductive drum 11 and a belt 54 is mounted around the transfer roller 17 and the feed roller 52. A pressure roller 53 opposes the feed roller 52 and is in pressure contact with the belt 54. It is to be noted that the contact area between the pressure roller 53 and the belt 54 is located at a height set above the transfer point P1 so that the print paper travels on a down slope toward the transfer point P1. As shown in FIG. 10, the pressure roller 53 and the feed roller 52 rotate in directions shown by arrows I and J, respectively, so that the print paper 16 is sandwiched between the pressure roller 53 and the belt 54 and guided in the direction shown by arrow P.

The print paper 16 is guided in such a way that the leading end of the print paper 16 reaches the transfer point P1 after the leading end has approached sufficiently close to the surface of the photoconductive drum 11. Since the print paper 16 passes between the pressure roller 53 and the feed roller 52 in contact with the round surface of the feed roller 52, the direction of travel of the print paper 16 does not change sharply. This is advantageous in that paper jam is prevented.

Seventh Embodiment

Figure 11:
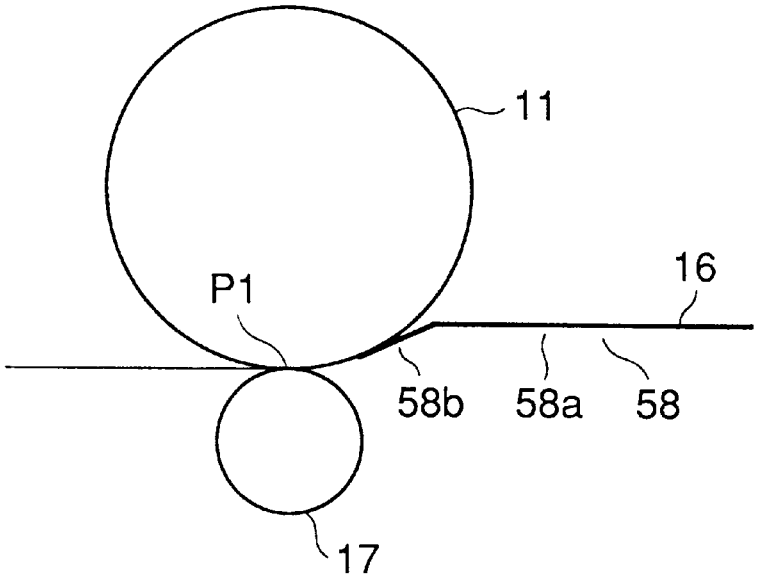
FIG. 11 illustrates an electrophotographic printer according to a seventh embodiment.

FIG. 11 illustrates an electrophotographic printer according to the seventh embodiment. Elements of the same construction as those of the first embodiment have been given the same reference numerals and the description thereof is omitted. In the seventh embodiment, a plate 58 has a horizontal part 58*a* and a down slope part 58*b*. The horizontal part 58*a* is located above the transfer point P1 and upstream of the transfer point P1 with respect to the direction of travel of the print paper 16. This arrangement ensures that the print paper 16 reaches the transfer point P1 after the leading end of the point paper 16 has been sufficiently close to the photoconductive drum.

Eighth Embodiment

Figure 12:
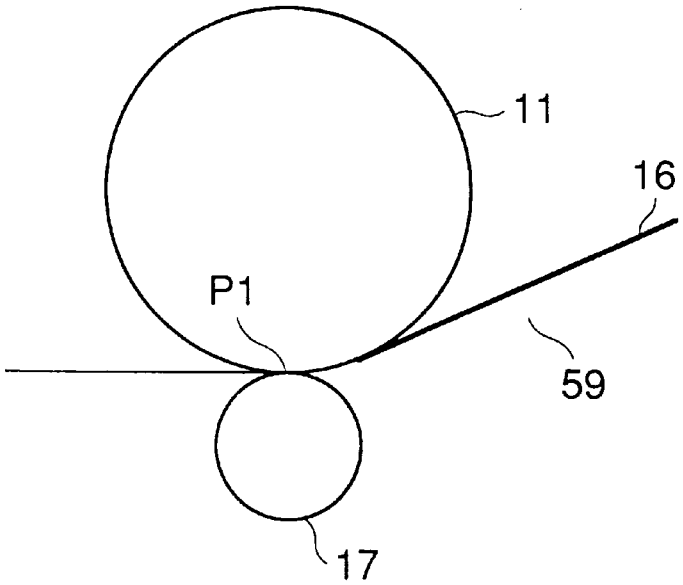
FIG. 12 illustrates an electrophotographic printer according an eighth embodiment.

FIG. 12 illustrates an electrophotographic printer according an eighth embodiment. Elements of the same construction as those of the first embodiment have been given the same reference numerals and the description thereof is omitted. In the eighth embodiment, a plate 59 is located upstream of the transfer point P1 with respect to the direction of travel of the print paper 16, and is disposed to define a down slope that goes down substantially toward the transfer point P1. This arrangement ensures that the print paper 16 reaches the transfer point P1 after the leading end of the point paper 16 has approached sufficiently close to the photoconductive drum 11.

Ninth Embodiment

In the aforementioned embodiments, paper guiding means is disposed upstream of the transfer point P1 with respect to the direction of travel of the print paper 16. The paper guiding means guide the print paper 16 so that the leading end of the print paper 16 is brought into contact with the photoconductive drum 11 at a location upstream of the transfer point P1. However, in the first to third embodiments and the seventh and eighth embodiments, the paper guiding means guide the print paper 16 in such a way that the direction of travel of the print paper is quickly changed. This may cause paper jam to occur.

Figure 13:
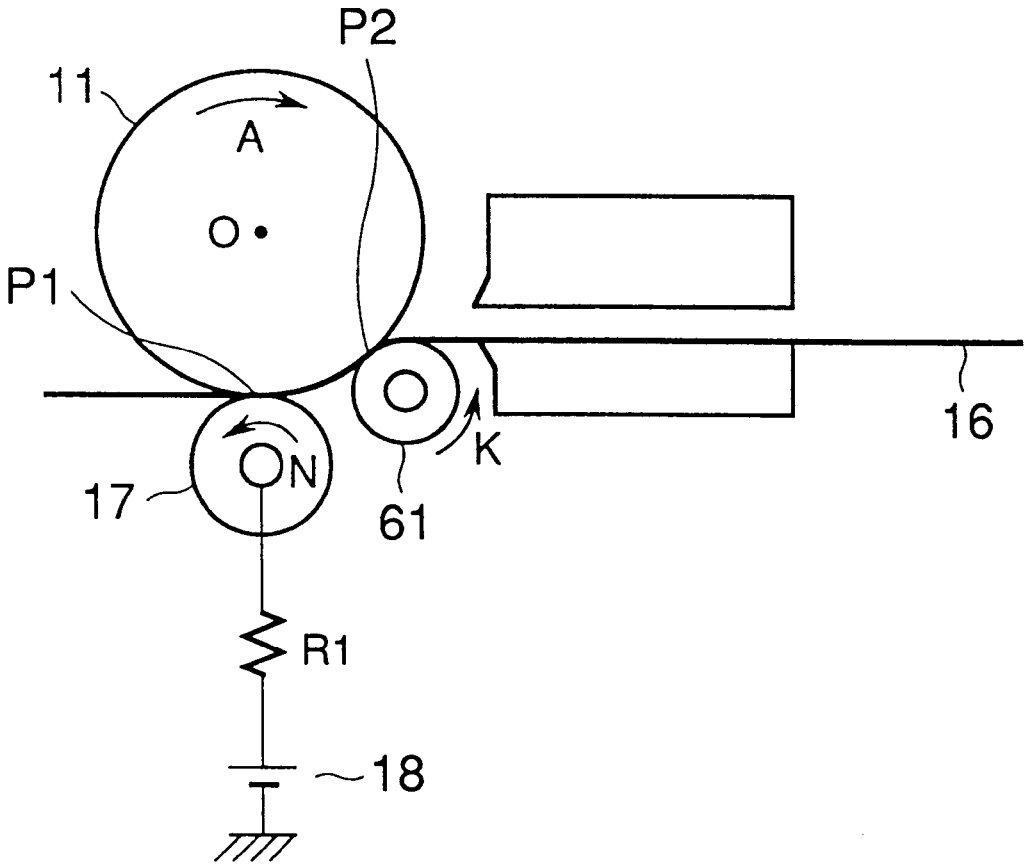
FIG. 13 illustrates an electrophotographic printer according to a ninth embodiment.

A ninth embodiment is to prevent paper jam which may occur when the direction of travel of the print paper is changed. FIG. 13 illustrates an electrophotographic printer according to the ninth embodiment. Elements of the same construction as those of the first embodiment have been given the same reference numerals and the description thereof is omitted.

In the ninth embodiment, an auxiliary transfer roller 61 is disposed in pressure contact with the photoconductive drum 11 to provide an auxiliary transfer point P2 defined between the photoconductive drum 11 and the auxiliary transfer roller 61. A resistor R1 is connected between the transfer power supply 18 and the transfer roller 17.

When the print paper 16 advances toward the transfer point P1, the print paper 16 is pressed against the photoconductive drum 11 both at the transfer point P1 and at the auxiliary transfer point P2, so that the print paper 16 has a large area in contact with the photoconductive drum 11 over a distance between the auxiliary transfer point P2 and the transfer point P1. This ensures that the print paper 16 is brought into contact with the photoconductive drum 11 before the leading end of the print paper 16 reaches the transfer point P1.

Since the print paper 16 travels along the circumferential surface of the auxiliary transfer roller 61 to the auxiliary transfer point P2, the direction of travel of the print paper 16 is not sharply changed. Thus, the paper jam is prevented from occurring when the direction of travel of the print paper 16 is changed by the auxiliary transfer roller 61.

Tenth Embodiment

Figure 14:
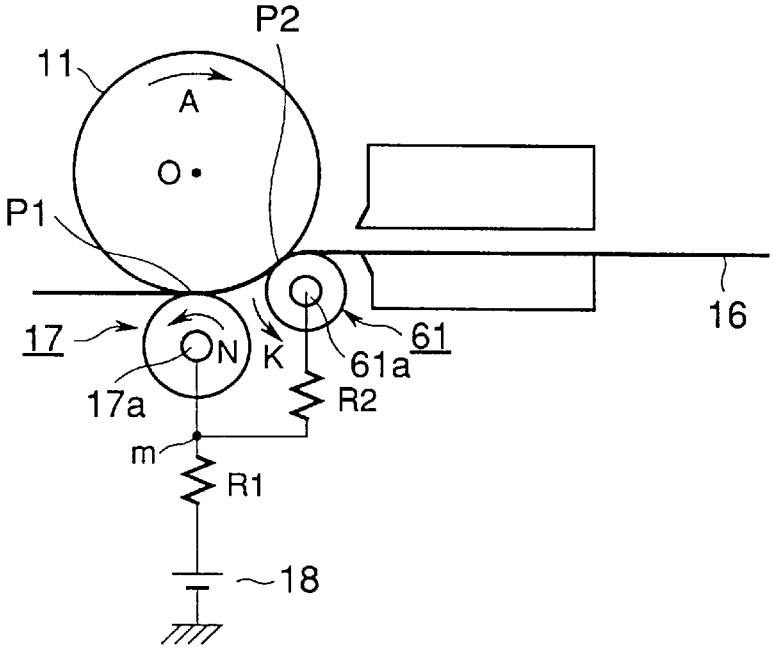
FIG. 14 illustrates an electrophotographic printer according to a tenth embodiment.

FIG. 14 illustrates an electrophotographic printer according to a tenth embodiment. Elements of the same construction as those of the ninth embodiment have been given the same reference numerals and the description thereof is omitted.

In the tenth embodiment, a transfer power supply 18 is connected via a resistor R1 to a metal shaft 17*a* of a main transfer roller 17. Also, a junction m of the resistor R1 and the metal shaft 17*a* is connected via a resistor R2 to a metal shaft 61*a* of the auxiliary transfer roller 61.

The transfer power supply 18 supplies a transfer voltage to the main transfer roller 17 and an auxiliary voltage to the auxiliary transfer roller 61. The resistors R1 and R2 and the conductive materials of the main transfer roller 17 and auxiliary transfer roller 61 have resistance values such that the surface potential of the main transfer roller 17 is higher than that of the auxiliary transfer roller 61. If the main transfer roller 17 and the auxiliary transfer roller 61 are made of the same conductive material or of the same electrical characteristics, only the resistor R2 needs to be connected between the junction m and the metal shaft 61*a*.

As mentioned above, the main transfer roller 17 receives a higher voltage than the auxiliary transfer roller 61 so that the surface potential of the main transfer roller 17 is higher than that of the auxiliary transfer roller 61. Thus, the electric field developed between the photoconductive drum 11 and the auxiliary transfer roller 61 is lower than that developed between the photoconductive drum 11 and the main transfer roller 17. This arrangement reduces changes in electric field at the transfer point P1 so that the toner 15 (FIG. 35) on the photoconductive drum 11 will not be pulled away from the surface of the photoconductive drum 11 by the Coulomb force, thus preventing poor transfer results.

In the tenth embodiment, some of the charges remaining on the photoconductive drum 11 after the charged surface has been exposed to image light are neutralized before the print paper 16 reaches the transfer point P1. Therefore, the print paper 16 can pass the transfer point P1 without any disturbances. Thus, the construction improves the quality of printed images.

Eleventh Embodiment

Figure 15:
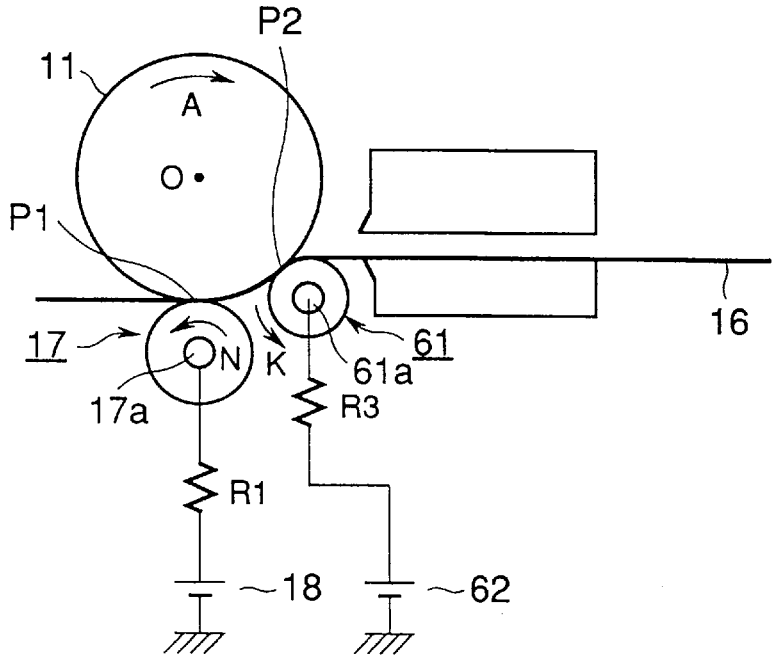
FIG. 15 illustrates an electrophotographic printer according to an eleventh embodiment.

FIG. 15 illustrates an electrophotographic printer according to an eleventh embodiment. Elements of the same construction as those of the tenth embodiment have been given the same reference numerals and the description thereof is omitted.

In the eleventh embodiment, there is provided an auxiliary transfer power supply 62 that applies an auxiliary voltage of the same polarity as a transfer voltage applied to the transfer roller 17. The auxiliary voltage is supplied from the auxiliary transfer power supply 62 via a resistor R3 to a metal shaft 61*a* of the auxiliary transfer roller 61.

The resistance values of resistors R1 and R3, the resistances of the conductive materials of the transfer roller 17 and auxiliary transfer roller 61, and the transfer voltage and auxiliary voltage are selected such that the surface potential of the transfer roller 17 is higher than that of the auxiliary transfer roller 61.

Twelfth Embodiment

If there are any changes in conditions such as temperature and humidity of the environment in which the electrophotographic printer operates, there will be changes in conditions in which the print paper 16 is brought into contact with the photoconductive drum 11. Thus, it is not ensured that good transfer results are achieved. A twelfth embodiment ensures that poor transfer results are prevented from occurring.

FIG. 16 is a table which lists auxiliary voltages in volts in the twelfth embodiment for different temperature ranges and humidity ranges.

The characteristics of the print paper 16 (FIG. 15) vary in accordance with temperature T and humidity H. Accordingly, an optimum value of the auxiliary voltage applied to the auxiliary transfer roller 61 changes in accordance with the temperature and humidity. Generally speaking, the resistance of the print paper 16 is high at low temperature and low humidity, so that the electric field developed between the print paper 16 and the photoconductive drum 11 is low. The resistance of the print paper 16 is low at high temperature and high humidity so that the electric field is high.

The optimum values of auxiliary voltage applied to the auxiliary transfer roller 61 for different temperatures T and humidity H can be previously determined by calculation and experiment. The optimum values are tabulated as shown in FIG. 16 and are then stored in a memory of a controller, not shown. Prior to a printing operation, the controller first detects the conditions of an environment in which the printer is placed. Then, the controller reads a value of auxiliary voltage corresponding to the temperature T and humidity H detected by a temperature sensor and a humidity sensor, not shown, respectively. Upon starting the printing operation, the controller turns on the auxiliary transfer power supply 62 at a predetermined timing, thereby applying the thus determined auxiliary voltage to the transfer roller 61.

As mentioned above, an optimum auxiliary voltage can be applied in accordance with changes in environmental conditions, thereby improving the quality of printed images.

Thirteenth Embodiment

If the print paper 16 vary in thickness depending on the kinds of print paper, the print paper 16 is brought into contact with the photoconductive drum 11 with different contact conditions. Thus, it is difficult to ensure that no poor transfer result occurs.

A thirteenth embodiment prevents poor transfer results from occurring even if the print paper 16 varies in thickness.

FIG. 17 illustrates the relationship between the kinds of print paper and auxiliary voltages in the thirteenth embodiment.

Referring to FIG. 17, M1 to M4 represent different kinds of the print paper 16 (FIG. 5) and $\epsilon 1$–$\epsilon 6$ indicate different environments in which the electrophotographic printer is placed. If the print paper 16 differs in thickness, stiffness, size, and material, the print paper has different electrical characteristics accordingly. For example, thick print paper 16 has a higher electrical resistance.

High electrical resistances of the print paper 16 cause low electric fields to be developed between the print paper 16 and the photoconductive drum 11 while low electrical resistances cause high electric fields. Thus, an optimum value of auxiliary voltage applied to the auxiliary transfer roller 61 depends on the kind of the print paper 16.

The optimum values of the auxiliary voltage applied to the auxiliary transfer roller 61 are previously determined by, for example, calculation and experiment. The optimum values are tabulated as shown in FIG. 17 and are stored in a memory of a controller, not shown.

Prior to a printing operation, upon an instruction from a host computer, not shown, the controller identifies the kind of print paper from the user's selection on the operation panel, not shown. Then, the controller reads the table of FIG. 17 to determine a value of auxiliary voltage to be applied to the auxiliary transfer roller 61. When a printing operation begins, the controller turns on the auxiliary power supply 62 at a predetermined timing so as to apply an auxiliary voltage to the auxiliary transfer roller 61.

As described above, an optimum auxiliary voltage can be applied to the auxiliary transfer roller 61 in accordance with the kind of print paper 16, thereby improving the quality of printed images irrespective of different environmental conditions.

Fourteenth Embodiment

Figure 18:
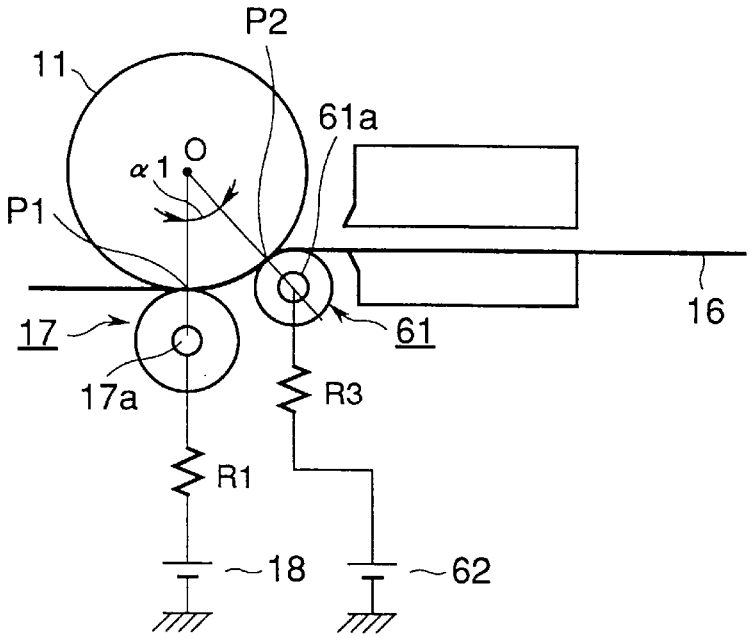
FIG. 18 shows the positional relationship among the photoconductive drum 11, transfer roller 17, and the auxiliary roller 61 of a fourth embodiment when the angle $\alpha$ is large.
Figure 19:
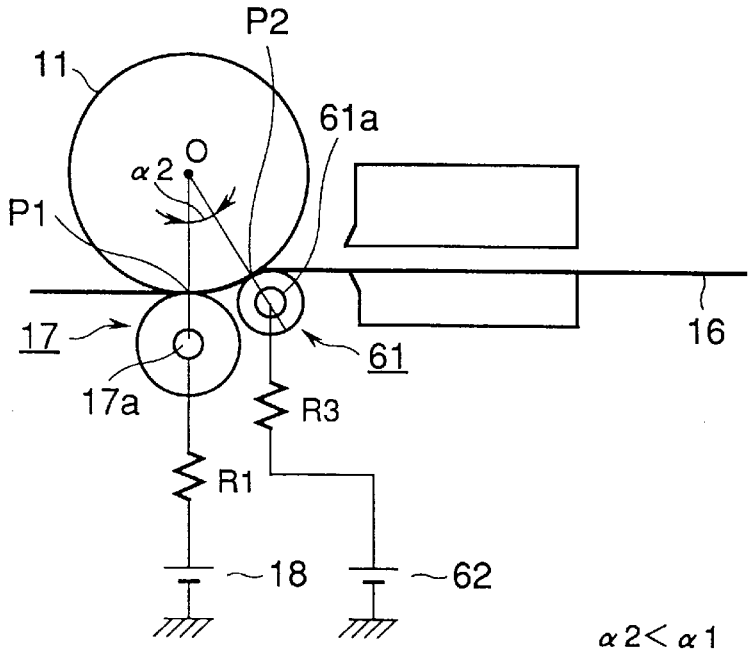
FIG. 19 shows the positional relationship when the angle $\alpha$ is small.

FIGS. 18 and 19 illustrate an electrophotographic printer according to a fourteenth embodiment. FIG. 20 is a table that lists circumferential distance of an auxiliary transfer roller 61 from a main transfer roller 17 expressed in angles for different kinds of print paper and different ranges of humidity, the circumferential distances being distances over which the print paper is in contact with the photoconductive drum. The circumferential distances are expressed in terms of angles in degrees. Elements of the same construction as those of the eleventh embodiment have been given the same reference numerals and the description thereof is omitted.

In the fourteenth embodiment, an auxiliary transfer roller 61 can be moved along the circumferential surface of the photoconductive drum 11. That is, an acute angle α is defined by two lines; the first is a line passing through the center O of the photoconductive drum 11 and the center of the auxiliary transfer roller 61 and the second is a line passing through the centers of the photoconductive drum 11 and the transfer roller 17. Moving the auxiliary transfer roller 61 along the surface of the photoconductive drum 11 causes the acute angle α to change.

FIG. 18 shows the positional relationship among the photoconductive drum 11, transfer roller 17, and the auxiliary roller 61 when the angle α is a large angle α1. FIG. 19 shows the positional relationship when the angle α is a small angle α2.

Differences in thickness, stiffness, size, and material and so on differ depending on the kind of the print paper 16 and can cause different problems in transporting the print paper along the transport path, not shown. For example, when printing is made on thick paper such as postal card, the direction of travel of the postal card is changed quickly if the angle α is large. As a result, the postal card is curled, folded, or even jammed.

In the fourteenth embodiment, the angle α is adjusted in accordance with the humidity of the environment in which the print paper and the electrophotographic printer are placed.

The optimum values of the angle α can be determined by, for example, calculation or experiment in accordance with the kind of the print paper 16 and the humidity of the environments in which print paper and the electrophotographic printer are placed. The optimum values of angle α can be tabulated and are stored in a memory of a controller, not shown.

Prior to printing operation, the controller identifies the kind of the print paper 16 based on the instructions from a host computer, not shown. Then, the controller reads the table in the memory to determine an angle α corresponding to the humidity detected by a humidity sensor.

As described above, the angle α may be adjusted to an optimum value in accordance with the humidity H of an environment in which the kind of print paper 16 and electrophotographic printer are placed, thereby improving the quality of printed images. Moreover, there is no possibility of thick paper being folded or jammed.

Fifteenth Embodiment

Figure 21:
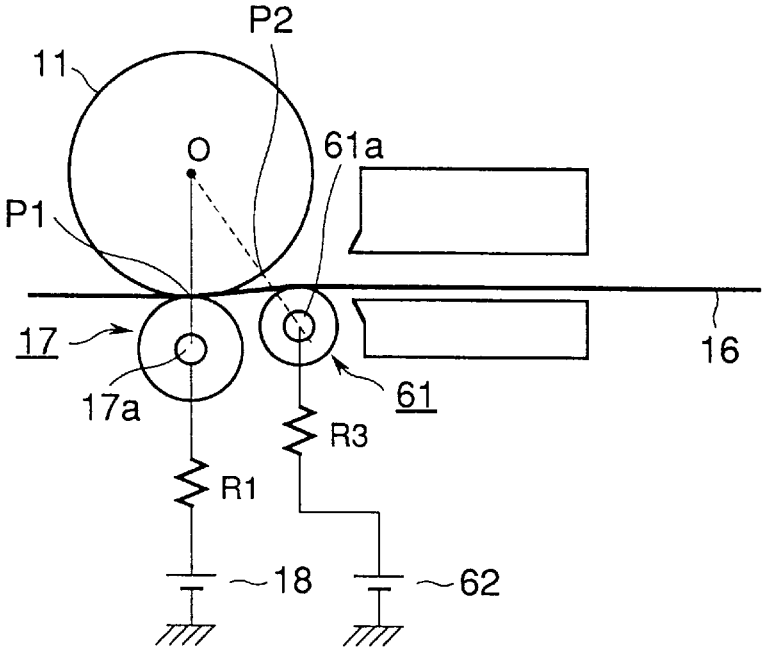
FIG. 21 shows the auxiliary transfer roller 61 of a fifteenth embodiment when it is away from the photoconductive drum 11.
Figure 22:
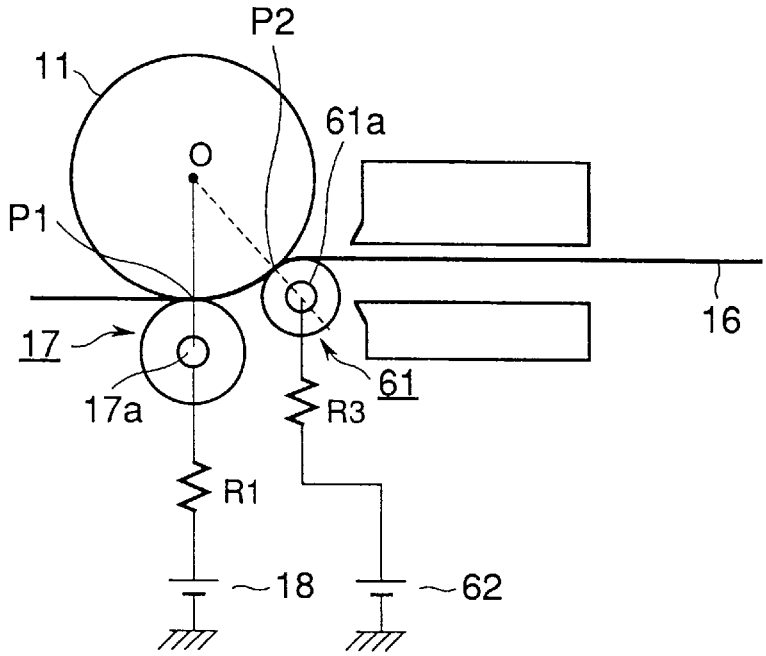
FIG. 22 shows the auxiliary transfer roller 61 when it is closer to the photoconductive drum 11.

FIGS. 21 and 22 illustrate an electrophotographic printer according to a fifteenth embodiment.

FIG. 23 is a table that lists the distances in millimeters between the photoconductive drum 11 and the auxiliary transfer roller 61 for different kinds of print paper 16 and different ranges of humidity. Elements of the same construction as those of the eleventh embodiment have been given the same reference numerals.

For example, a post card is a quite stiff print paper. If the post card is pressed firmly against the photoconductive drum, the postcard will remain curled after transferring operation. A curled print paper is troublesome. It is often be jammed.

In the fifteenth embodiment, an auxiliary transfer roller 61 is movable relative to the photoconductive drum 11 in a radial direction of the photoconductive drum 11, thereby allowing setting of a distance between the shafts of the auxiliary transfer roller 61 and the photoconductive drum 11 in such a way that the print paper is supported between the auxiliary roller and photoconductive drum 11 with a desirable pressure. This implies that the print paper is urged against the photoconductive drum 11 with different urging forces depending on the kind of print paper. Some kind of print paper 16 is urged against the photoconductive drum 11 with a little or no pressure.

FIG. 21 shows the auxiliary transfer roller 61 when the distance between the auxiliary transfer roller 61 and the photoconductive drum 11 is long. FIG. 22 shows the auxiliary transfer roller 61 when the distance between the auxiliary transfer roller 61 and the photoconductive drum 11 is short. M1 to M3 represent different kinds of print paper 16. The print paper 16 varies in thickness, stiffness, size, and material depending on its kinds. Thus, various problems may occur when the print paper 16 travels in the transport path, not shown. For example, when printing on thick paper such as a postal card, if the distance between the photoconductive drum 11 and the auxiliary transfer roller 61 is short, the direction of travel of the print paper 16 is sharply changed by a large amount. As a result, the thick paper may be curled, folded, or jammed.

In the fifteenth embodiment, the auxiliary transfer roller 61 is displaced toward or away from the photoconductive drum 11 so that the distance between the photoconductive drum 11 and the auxiliary transfer roller 61 varies in accordance with the kind of print paper 16 and the humidity H of the environment in which the print paper 16 and the electrophotographic printer are placed. Optimum values of the distance are previously determined by, for example, calculation or experiment in accordance with the humidity H of the environment in which the print paper 16 and the electrophotographic printer are placed. The optimum values of the distance are tabulated and stored in a memory of a controller, not shown.

In response to the instruction from a host computer, not shown, prior to a printing operation, the controller identifies the kind of print paper 16 which the user selects on the operation panel, not shown, of the electrophotographic printer. Then, the controller reads the table in the memory using humidity H detected by a humidity sensor, not shown, to determine an optimum distance between the photoconductive drum 11 and the auxiliary transfer roller 61.

Setting an optimum distance between the photoconductive drum 11 and the auxiliary transfer roller 61 in accordance with environmental humidity improves the quality of printed images and reduces the chances of print paper being curled, folded, or jammed.

Although the auxiliary transfer roller 61 is automatically positioned relative to the photoconductive drum 11 during printing operation in accordance with the environmental humidity, the auxiliary transfer roller 61 can be retracted from the photoconductive drum 11 when paper jam occurs so that the jammed paper can easily be taken out.

Sixteenth Embodiment

Figure 24:
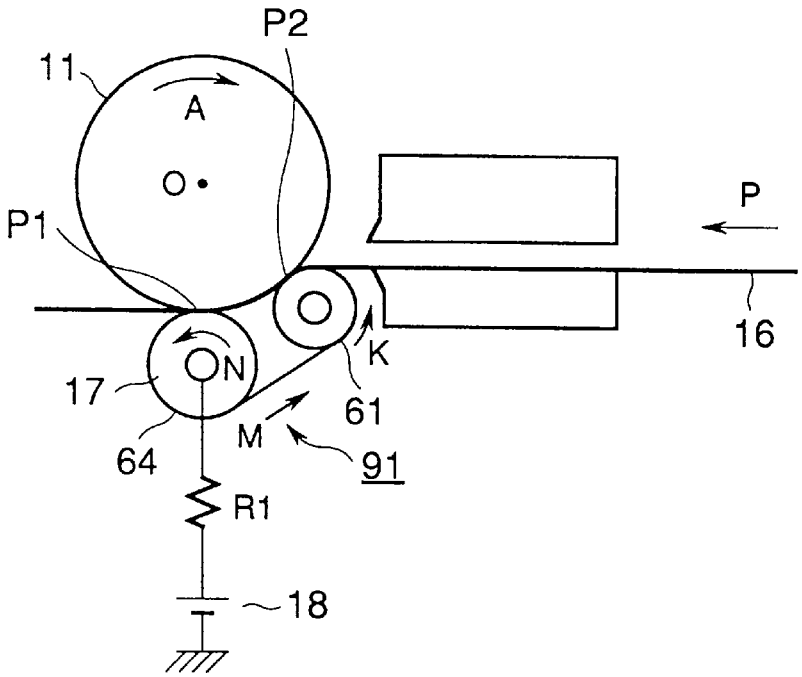
FIG. 24 illustrates an electrophotographic printer according to a sixteenth embodiment.
Figure 25:
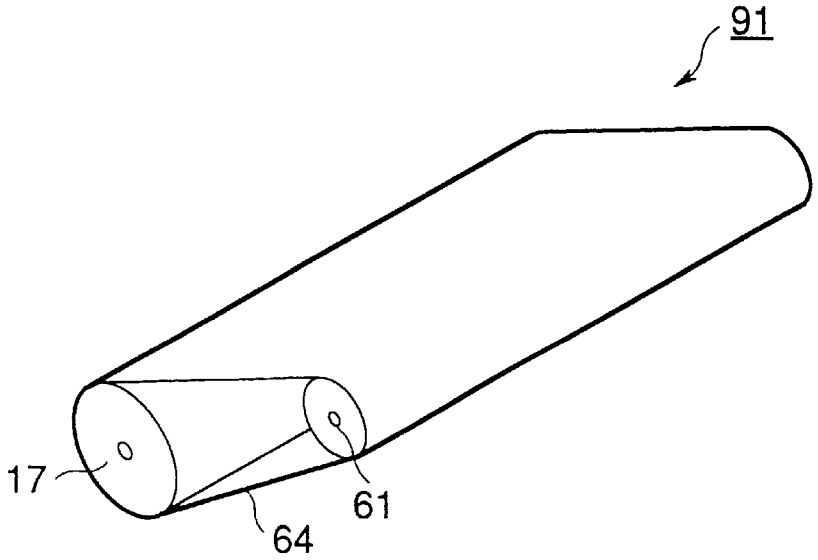
FIG. 25 is a perspective view showing a relevant portion of a transfer unit of FIG. 24.
Figure 26:
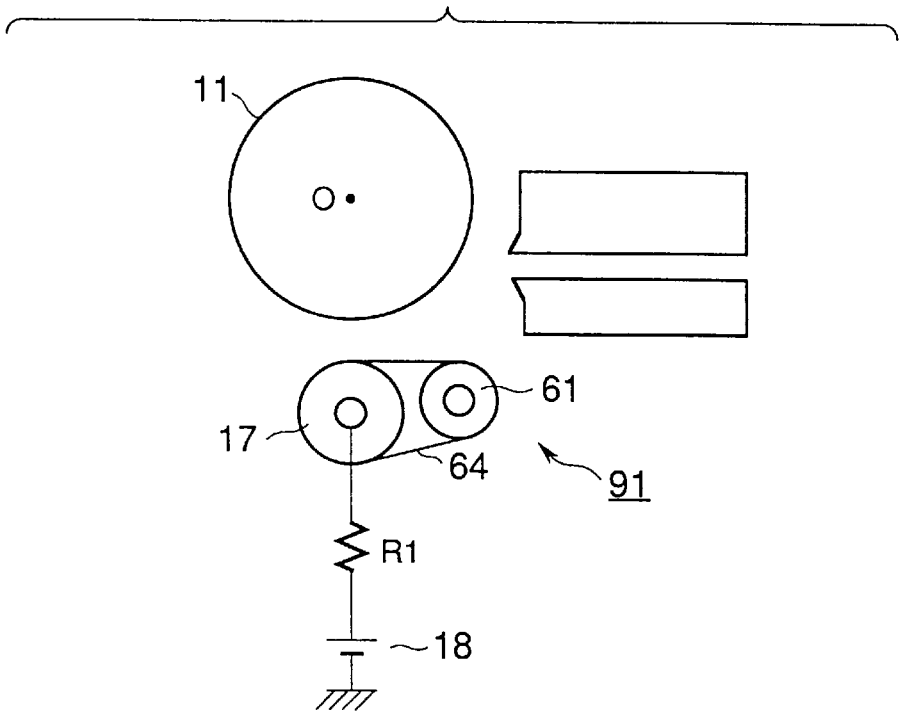
FIG. 26 illustrates an electrophotographic printer according to a sixteenth embodiment.

FIGS. 24 and 26 illustrate an electrophotographic printer according to a sixteenth embodiment. FIG. 25 is a perspective view showing a relevant portion of a transfer unit. Elements of the same construction as those of the ninth embodiment have been given the same reference numerals and the description thereof is omitted.

In the sixteenth embodiment, a transfer unit 91 includes a main transfer roller 17, an auxiliary transfer roller 61, and a transfer belt 64. The transfer belt 64 is made of a high resistance electrically conductive material and mounted on the main transfer roller 17 and the auxiliary transfer roller 61. The transfer belt 64 is held taut or with little tension. The transfer unit 91 is pivotal about the rotational shaft of the main transfer roller 17 and is brought into or out of contact with the photoconductive drum 11. During the printing operation, the transfer unit 91 is at a position shown in FIG. 24, so that the transfer roller 17 and the auxiliary transfer roller 61 are pressed against the photoconductive drum 11. Thus, the transfer belt 64 runs in a direction shown by arrow M as the photoconductive drum 11. An area of the transfer belt 64 between the auxiliary transfer point P2 and transfer point P1 is brought into contact with the photoconductive drum 11.

The transfer belt 64 has a width as wide as the longitudinal length of the main transfer roller 17 and auxiliary transfer roller 61. The print paper 16 is transported in a direction shown by arrow P and is then pulled in between the photoconductive drum 11 and the transfer belt 64. When the print paper 16 travels from the auxiliary transfer point P2 to the transfer point P1, the print paper 16 is pressed against the photoconductive drum with uniform as pressure. The print paper leaves the photoconductive drum 11 after the print paper 16 has passed the transfer point P1. Urging the print paper against the photoconductive drum 11 with uniform pressure improves the quality of printed images.

When paper jam occurs, the transfer unit 91 may be positioned away from the photoconductive drum 11 as shown in FIG. 26 so that the jammed paper can easily be taken out. In the sixteenth embodiment, the auxiliary transfer roller 61 does not receive an auxiliary voltage. However, an auxiliary voltage may be applied to the auxiliary roller 61 just as in the tenth and eleventh embodiments. The auxiliary voltage may be changed in accordance with changes in environmental conditions just as in the twelfth embodiment or in accordance with the kind of print paper 16 just as in the thirteenth embodiment.

Seventeenth Embodiment

Figure 27:
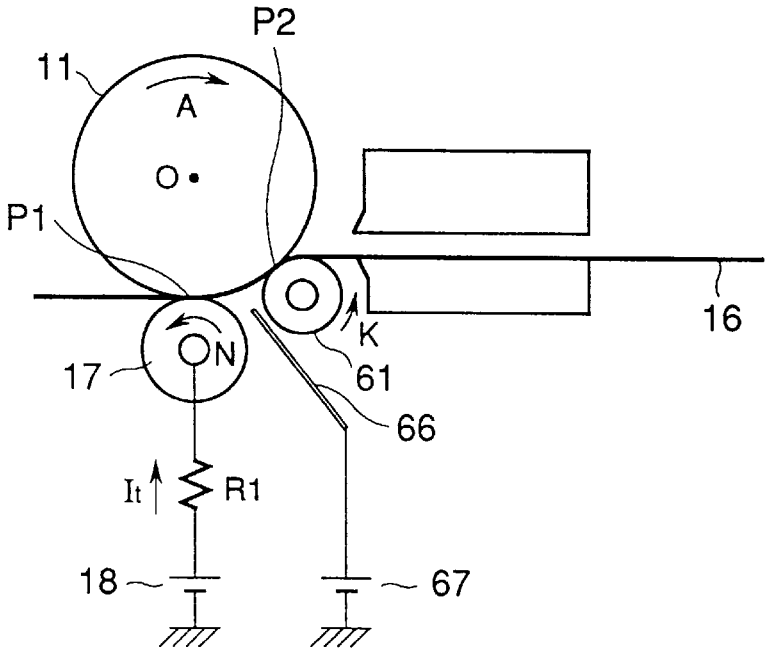
FIG. 27 illustrates an electrophotographic printer according to a seventeenth embodiment.
Figures 28, 29:
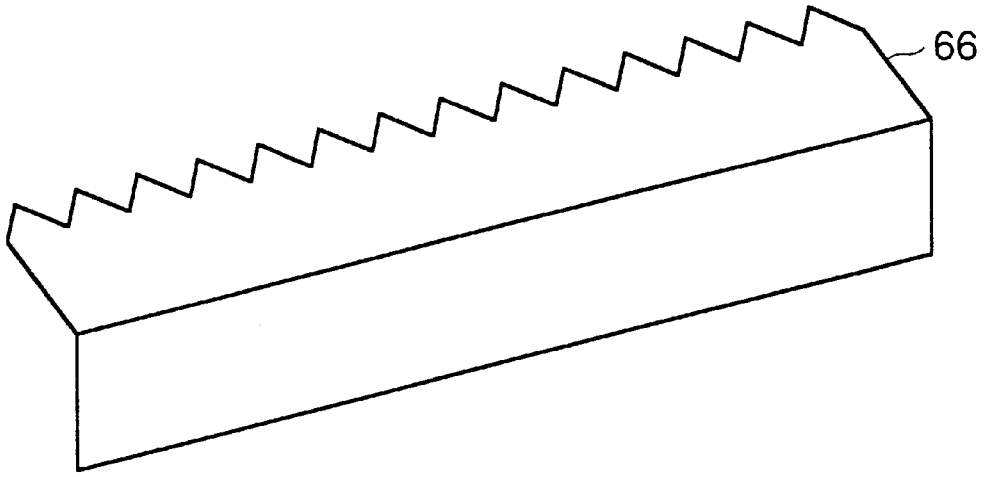
FIG. 28 is a perspective view of a neutralizer.
FIG. 29 illustrates the relationships between the kind of print paper and neutralization voltage according to an eighteenth embodiment.

FIG. 27 illustrates an electrophotographic printer according to a seventeenth embodiment. FIG. 28 is a perspective view of a neutralizer. Elements of the same construction as those of the ninth embodiment have been given the same reference numerals and the description thereof is omitted.

In the aforementioned ninth to sixteenth embodiments, when an electrostatic latent image is formed on the surface of the photoconductive drum 11, the charges (negative charges in the seventeenth embodiment) remain on areas which have not been exposed to image light. When the toner image is transferred to the print paper 16, the transfer voltage (positive voltage in the seventeenth embodiment) applied to the transfer roller 17 removes the charges remaining on the photoconductive drum 11.

When the charges are removed from the photoconductive drum 11, a current flows through a resistor R1. If non-exposed areas are relatively large and therefore a large amount of charges remain on the photoconductive drum 11, the current flowing through the resistor R1 is large. If non-exposed areas are relatively small and therefore a small amount of charges remain on the photoconductive drum 11, the current flowing through the resistor R1 is small.

When the area of the non-image region changes due to changes in the pattern of image, the current flowing through the resistor R1 during the transfer operation changes. As a result, the electric field developed between the photoconductive drum 11 and the transfer roller 17 changes.

Changes in electric field cause the quality of printed images to deteriorate.

The seventeenth embodiment eliminates the variations of electric field developed between the photoconductive drum 11 and the transfer roller 17.

Referring to FIG. 27, a neutralizing member 66 is disposed in the transport path of the print paper 16 between the auxiliary transfer point P2 and the transfer point P1. The neutralizing member 66 opposes the photoconductive drum 11 but is not in contact with the photoconductive drum 11. The neutralizing member 66 receives a predetermined neutralizing voltage from a neutralization power supply 67. The neutralizing member 66 has a front end in the shape of a triangular wave, and is disposed with the front end opposing the photoconductive drum 11 so that charges on the surface of the photoconductive drum 11 opposing the front end of the neutralizing member 66 are easily removed. The neutralizing member 66 and neutralization power supply 67 form a neutralizing means.

The seventeenth embodiment allows charges on the photoconductive drum 11 to be neutralized from behind the print paper 16 whose front surface is in contact with the photoconductive drum 11. Thus, the current flowing through the resistor R1 will not change significantly even if the image pattern changes. This implies that the electric field developed between the photoconductive drum 11 and the main transfer roller 17 will be sufficiently stable, improving the quality of printed images.

Figure 35:
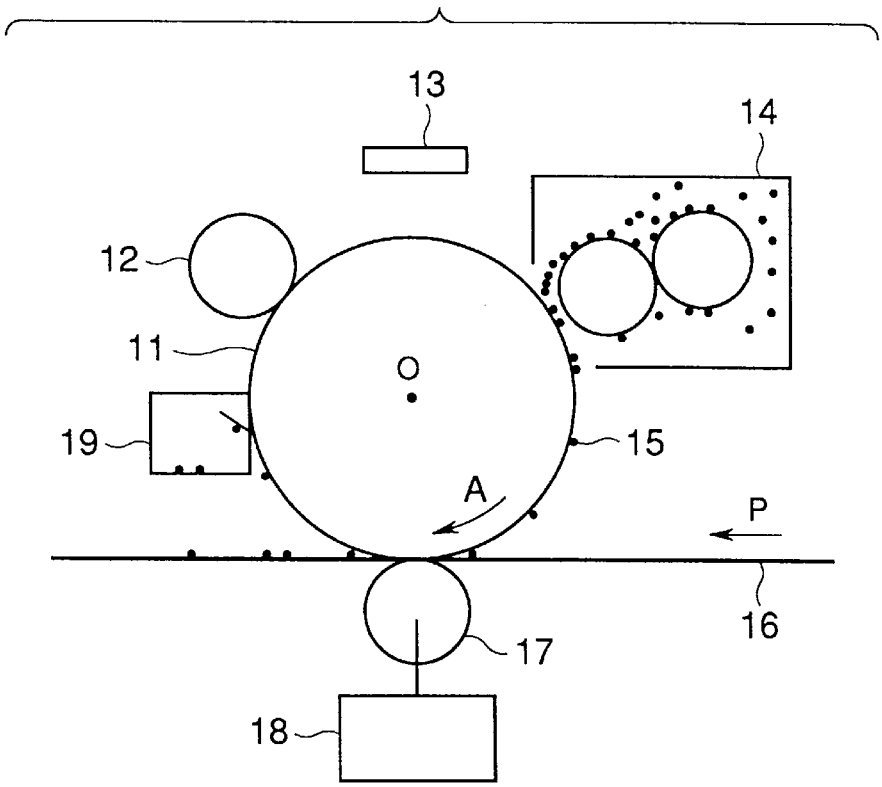
FIG.35 CONVENTIONAL ART
FIG. 35 illustrates a general construction of a conventional electrophotographic printer.
Figure 36:
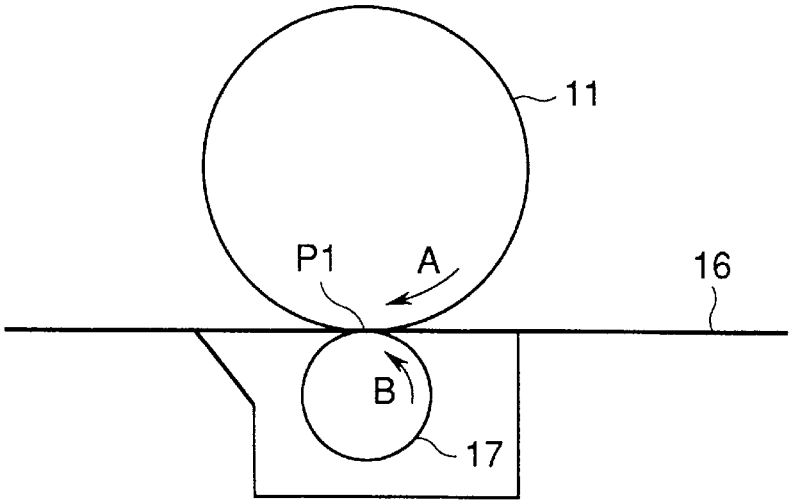
FIG.36 CONVENTIONAL ART
FIG. 36 is a side view of a paper transporting path of the conventional electrophotographic printer of FIG. 35.

When neutralizing the charges on the photoconductive drum 11 from behind the print paper 16, an electric field is developed between the neutralizing member 66 and the photoconductive drum. However, since the print paper 16 has a large area in contact with the photoconductive drum 11, there is no chance of the toner image moving or toner 15 being pulled away from the surface of the photoconductive drum (FIG. 35). This improves quality of printed images.

In the seventeenth embodiment, an auxiliary voltage is not applied to the auxiliary transfer roller 61 but may of course be applied to the auxiliary roller 61 just as in the tenth and eleventh embodiments. The auxiliary voltage may be changed in accordance with changes in environmental conditions just as in the twelfth embodiment or in accordance with the kind of print paper 16 just as in the thirteenth embodiment.

Eighteenth Embodiment

An eighteenth embodiment is of the same construction as the seventeenth embodiment shown in FIG. 27. FIG. 29 illustrates the relationships between the kind of print paper and neutralization voltage according to an eighteenth embodiment. Referring to FIG. 29, M1 to M3 represent different kinds of the print paper 16 (FIG. 27).

In the eighteenth embodiment, changes in thickness, stiffness, size, and material cause changes in characteristics of the print paper 16. Thus, the optimum values of the neutralization voltage applied to the neutralizing member 66 changes depending on the kind of the print paper 16. If the print paper 16 is thick, low neutralization voltages can not neutralize all of the charges. If the print paper is thin, high neutralization voltages damage the toner images.

In the eighteenth embodiment, the neutralization voltage is changed in accordance with the kind of the print paper 16. The neutralization voltages are determined previously by, for example, calculation or experiment in accordance with the kind of the print paper 16. The neutralization voltages are tabulated and stored in a memory of a controller, not shown.

In response to the instruction from a host computer, not shown, prior to printing operation, the controller identifies the kind of the print paper 16 based on the user's selection on the operation panel, not shown, of the electrophotographic printer. Then, the controller reads a tabulated neutralization voltage corresponding to the kind of the print paper 16.

In this manner, the quality of printed images may be improved.

Nineteenth Embodiment

Figures 31, 32:
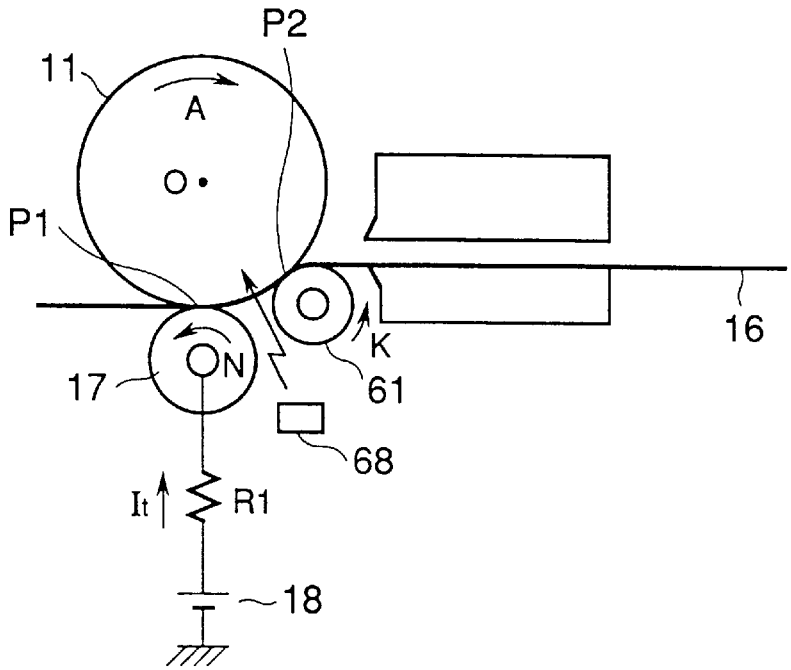
FIG. 31 is a table that lists neutralization voltages for different kinds of print paper and different environments.
FIG. 32 illustrates an electrophotographic printer according to a twentieth embodiment.

FIG. 30 is a table that lists environments defined for different ranges of temperature and different ranges of humidity. FIG. 31 is a table that lists neutralization voltages for different kinds of paper and different environments.

Referring to FIGS. 30 and 31, M1 to M3 indicate the kind of the print paper 16 (FIG. 27) and $\epsilon 1$ to $\epsilon 8$ represent different environment variables that are determined by environments in which the electrophotographic printer is placed.

In the nineteenth embodiment, the characteristics of the print paper change with environmental conditions, especially temperature T, humidity H, and the kind of print paper 16. Optimum values of neutralization voltage applied to the neutralizing member 66 are different depending on temperature, humidity, and the kind of the print paper 16.

In an environment of low temperature and low humidity, the resistance of the print paper 16 tends to increase. Thus, the neutralization voltage applied to the neutralizing member 66 is set high. In an environment of high temperature and high humidity, the resistance of the print paper 16 tends to decrease. Thus, the neutralization voltage is set low.

The environments $\epsilon 1$ to $\epsilon 8$ are previously determined by, for example, calculation or experiment for different temperature ranges and different humidity ranges. The environments are tabulated in Table 1 as shown in FIG. 30 and stored in a memory of a controller, not shown. The neutralization voltages are determined by, for example, calculation or experiment for different kinds of print paper 16 and environments $\epsilon 1$ to $\epsilon 8$. The neutralization voltages are tabulated in Table 2 as shown in FIG. 31, and stored in the memory of the controller.

In response to an instruction from a host computer, not shown, prior to a printing operation, the controller determines the kind of the print paper 16 based on the user's selection on the operation panel of the electrophotographic printer. Then, the controller reads an environment from Table 1 based on a temperature T detected by a temperature sensor and a humidity H detected by a humidity sensor. Finally, the controller reads a neutralization voltage from Table 2 based on the environment and the kind of the print paper 16.

For example, if temperature T is 22° C., and humidity H is 45%, the environment is $\epsilon 4$. Thus, the neutralization voltage is 1000 V for the kind of print paper M1.

Each of the environments $\epsilon 1$ to $\epsilon 8$ is determined with reference to a moisture content in air at a predetermined temperature and a predetermined humidity.

An optimum voltage set in the aforementioned manner improves the quality of printed images.

Upon starting a printing operation, the controller turns on the neutralization power supply 67 at a predetermined timing so as to apply the thus determined neutralization voltage.

Twentieth Embodiment

Figures 33, 34:
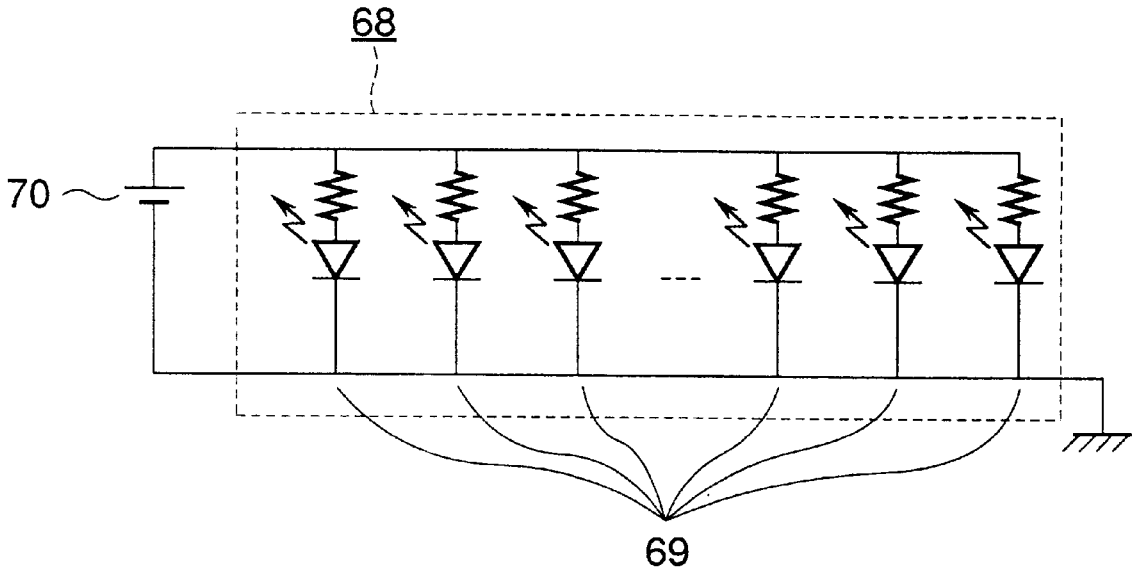
FIG. 33 illustrates a general configuration of a neutralization light source.
FIG. 34 illustrates the relationship between the kind of print paper and drive voltage in a twenty-first embodiment.

A twentieth embodiment will be described. FIG. 32 illustrates an electrophotographic printer according to a twentieth embodiment. FIG. 33 illustrates a general configuration of a neutralization light source. Elements of the same construction as the seventeenth embodiment have been given the same reference numerals and the description thereof is omitted.

In the seventeenth embodiment, a neutralizer 68 is disposed in the transport path of the print paper 16 between the auxiliary transfer point P2 and the main transfer point P1. The neutralizer 68 opposes the photoconductive drum 11 but is not in contact with the photoconductive drum 11. The neutralizer 68 receives a predetermined drive voltage from a power supply 70. The neutralizer 68 and power supply 70 form a neutralizing means.

The neutralizer 68 includes a light source in the form of a plurality of light emitting diodes 69. A controller, not shown, controls the drive voltages supplied from the power supply 70 to the light emitting diodes 69, and also turns on and off the power supply 70.

The light emitting diodes 69 illuminate the charged surface of the photoconductive drum 11 from behind the print paper 16 which is in contact with the photoconductive drum 11, thereby neutralizing the charges on the photoconductive drum 11. Therefore, even if the patterns of image change, the current flowing through the resistor R1 remains substantially constant. Consequently, the electric field developed between the photoconductive drum 11 and the transfer roller 17 will be substantially constant, improving the quality of printed images.

The output voltage of the power supply 70 can be changed so that the amounts of light emitted from light emitting diodes are adjusted by changing the output voltage, thereby adjusting neutralization effect.

When neutralizing the charges on the photoconductive drum 11 by illuminating from behind the print paper 16, an electric field is developed. However, since the print paper has a large area in contact with the photoconductive drum 11, there are no chances of the toner image being distorted or the toner 15 being pulled away form the surface of the photoconductive drum 11 (FIG. 35). This fact improves quality of printed images.

In the twentieth embodiment, although an auxiliary voltage is not applied to the auxiliary transfer roller 61, the auxiliary voltage may of course be applied to the auxiliary roller 61 just as in the tenth and eleventh embodiments. The auxiliary voltage may be changed in accordance with changes in environmental conditions just as in the twelfth embodiment or in accordance with the kind of print paper 16 just as in the thirteenth embodiment.

Twenty-First Embodiment

A twenty-first embodiment is of the same construction as the twentieth embodiment. FIG. 34 illustrates the relationship between the kind of print paper and drive voltage of light emitting diodes. Referring to FIG. 34, M1 to M3 represent the kind of the print paper 16 (FIG. 32).

In the twenty-first embodiment, changes in thickness, stiffness, size, and material of the print paper 16 cause changes in characteristics of the print paper 16. Thus, the optimum value of the drive voltage applied to the neutralizer 68 changes depending on the kind of the print paper 16. If the print paper 16 is thick, low drive voltages cannot completely neutralize the charges on the photoconductive drum 11. If the print paper 16 is thin, high drive voltages damage the toner images.

Thus, the drive voltages of the light emitting diodes are changed in accordance with the kind of the print paper 16.

The drive voltages are determined previously by, for example, calculation or experiment for different kinds of print paper 16. The drive voltages are tabulated and stored in a memory of a controller, not shown.

In response to the instruction from a host computer, not shown, prior to a printing operation, the controller identifies the kind of print paper 16 based on the user's selection on the operation panel, not shown, of the electrophotographic printer. Then, the controller reads a drive voltage from among the tabulated drive voltages corresponding to the kind of the print paper, thereby determining the optimum drive voltage.

As described above, the optimum drive voltage can be applied to the neutralizer 68 in accordance with the humidity of an environment in which the print paper 16 and the electrophotographic printer are placed, thereby improving the quality of printed images.

The invention thus being described, it will be obvious that the same may be varied in many ways. Such variations are not to be regarded as a departure from the spirit and scope of he invention, and all such modifications as would be obvious to one skilled in the art are intended to be included within the cope of the following claims.

What is claimed is:

1. An electrophotographic printer, comprising:

a transfer device which rotates in contact with a cylindrical image bearing body, said transfer device transfers a developed image on the image bearing body to a print medium when the print medium passes through a transfer point where said transfer device is in contact with the image bearing body; and a print medium guide which brings a leading end portion of the print medium into contact with the image bearing body at a location upstream of the transfer point with respect to a transport path of the print medium.

2. The electrophotographic printer according to claim 1, wherein said print medium guide urges the print medium against the image bearing body.

3. The electrophotographic printer according to claim 1, wherein said print medium guide has an up-slope and a down-slope downstream of the up-slope with respect to a transport path of a print medium, the down-slope extending toward the image bearing body, the print medium being advanced on the up-slope toward the image bearing body.

4. The electrophotographic printer according to claim 1, wherein said print medium guide has a down-slope on which the print medium travels toward the transfer point, the down slope going down toward the image bearing body in a direction tangent to a circumferential surface of the image bearing body before the transfer point.

5. The electrophotographic printer according to claim 1, wherein said print medium guide urges the print medium against the image bearing body.

6. The electrophotographic printer according to claim 5, wherein said print medium guide is a roller.

7. The electrophotographic printer according to claim 1, wherein said print medium guide guides the print medium in a direction substantially tangent to a circumferential surface of the image bearing body to bring a leading end portion of the print medium into contact with the image bearing body.

8. An electrophotographic printer, comprising:

a transfer device which rotates in contact with a cylindrical image bearing body, said transfer device transfers a developed image on the image bearing body to a print medium when the print medium passes through a transfer point where said transfer device is in contact with the image bearing body; and a print medium guide disposed upstream of the transfer point with respect to a transport path of the print medium, said print medium guide having an up-slope and a down-slope downstream of the up-slope with respect to the transport path, the up-slope and down-slope extending toward the image bearing body, the print medium being advanced on the up-slope and the down-slope toward the image bearing body such that a leading end portion of the print medium enters the transfer point in a direction tangent to a circumferential surface of the image bearing body.

9. An electrophotographic printer, comprising:

a transfer device which rotates in contact with a cylindrical image bearing body, said transfer device transfers a developed image on the image bearing body to a print medium when the print medium passes through a transfer point where said transfer device is in contact with the image bearing body; and a print medium guide disposed upstream of the transfer point with respect to a transport path of the print medium, said print medium guide having a down-slope on which the print medium travels toward the transfer point, the down slope going down toward the image bearing body in a direction tangent to the circumferential surface of the image bearing body before the transfer point such that a leading end portion of the print medium enters the transfer point in a direction tangent to a circumferential surface of the image bearing body.

10. An electrophotographic printer comprising:

a transfer device which rotates in contact with a cylindrical image bearing body, said transfer device transfers a developed image on the image bearing body to a print medium when the print medium passes through a transfer point where said transfer device is in contact with the image bearing body; and a print medium guide disposed upstream of the transfer point with respect to a transport path of the print medium, said print medium guide having a flap which is controllably inclined to make an up-slope that goes up toward the image bearing body, the print medium being advanced on the up-slope toward the image bearing body such that a leading end portion of the print medium enters the transfer point in a direction tangent to a circumferential surface of the image bearing body.

11. An electrophotographic printer, comprising:

a transfer device which rotates in contact with a cylindrical image bearing body, said transfer device transfers a developed image on the image bearing body to a print medium when the print medium passes through a transfer point where said transfer device is in contact with the image bearing body;

a medium sensor which is disposed upstream of the transfer point with respect to a transport path of the print medium and detects a leading end and a trailing end of the print medium; and a print medium guide disposed downstream of said medium sensor and upstream of the transfer point, said print medium guide being inclined to make an up-slope when the medium sensor detects the leading end of the print medium and is held horizontal when the trailing end of the print medium is subsequently detected by the medium sensor, so that the leading end portion of the print medium enters the transfer point in a direction tangent to a circumferential surface of the image bearing body.

12. An electrophotographic printer, comprising:

a transfer device which rotates in contact with a cylindrical image bearing body, said transfer device transferring a developed image on the image bearing body to a print medium when the print medium passes through a transfer point where said transfer device is in contact with the image bearing body; and an auxiliary transfer roller disposed upstream of the transfer point with respect to a transport path of the print medium, and forming an auxiliary transfer point where the auxiliary transfer roller rotates in contact with the image bearing body, said auxillary transfer roller urging the print medium against the image bearing body such that a leading end portion of the print medium enters the transfer point in a direction tangent to a circumferential surface of the image bearing body.

13. The electrophotographic printer according to claim 12, wherein the auxiliary transfer roller is movable along the surface of the image bearing body.

14. The electrophotographic printer according to claim 13, wherein the auxiliary transfer roller is moved such that a position of the auxiliary transfer roller relative to the image bearing body is in accordance with at least one of a kind of the print medium and an environment in which the electrophotographic printer and the print medium are placed.

15. The electrophotographic printer according to claim 12 further including a neutralizer disposed between the auxiliary transfer point and the transfer point with respect to the direction of travel of the print medium, the neutralizer opposing the image bearing body.

16. The electrophotographic printer according to claim 15, wherein the neutralizer includes a neutralizing member made of an electrically conductive material and a neutralization power supply which applies a neutralization voltage to the neutralizing member, the neutralization voltage being changed in accordance-with at least one of a kind of print medium and an environment in which the print medium and the electrophotographic printer are placed.

17. The electrophotographic printer according to claim 15, wherein the neutralizer includes a light source which illuminates the surface of the image bearing body and a power supply which supplies a drive voltage to the light source, the drive voltage being changed in accordance with at lease one of a kind of print medium and an environment in which the electrophotographic printer and the print medium are placed.

18. The electrophotographic printer according to claim 12, wherein the auxiliary transfer roller receives an auxiliary voltage.

19. The electrophotographic printer according to claim 18, wherein the auxiliary voltage is changed in accordance with at least one of a kind of the print medium and an environment in which the print medium and the electrophotographic printer are placed.

20. The electrophotographic printer according to claim 12, wherein the auxiliary transfer roller is movable from the image bearing body when a printing operation is not being performed.

21. The electrophotographic printer according to claim 12, wherein said transfer device is a transfer roller and a transfer belt is mounted on the transfer roller and the auxiliary transfer roller.

22. The electrophotographic printer according to claim 12, wherein the auxiliary transfer roller is movable in a radial direction of the image bearing body.

23. The electrophotographic printer according to claim 22, wherein said transfer device is a transfer roller and a transfer belt is mounted on the transfer device and the auxiliary transfer roller.

24. The electrophotographic printer according to claim 22, wherein the auxiliary transfer roller is moved such that a distance between the surface of the image bearing body and a rotational axis of the auxiliary transfer roller is in accordance with at least one of a kind of the print medium and an environment in which the electrophotographic printer and the print medium are placed.

* * * * *